United States Patent [19]

Hall et al.

[11] 4,108,276

[45] Aug. 22, 1978

[54] VENT SILENCER

[75] Inventors: Leonard F. Hall, Brooklyn; Robert A. Noreen, Stoughton, both of Wis.

[73] Assignee: Nelson Industries, Inc., Stoughton, Wis.

[21] Appl. No.: 724,545

[22] Filed: Sep. 20, 1976

[51] Int. Cl.[2] ..... F01N 1/08

[52] U.S. Cl. ..... 181/256; 181/257; 181/272

[58] Field of Search ..... 181/240, 252, 258, 282, 181/255, 256, 257, 230, 268, 269, 272, 275, 213, 224, 229, 250, 251, 231, 266, 270

[56] References Cited

U.S. PATENT DOCUMENTS

| | | | |
|---|---|---|---|
| 2,640,557 | 6/1953 | Gaffney | 181/256 |
| 2,764,250 | 9/1956 | Jeffords | 181/272 |
| 2,998,860 | 9/1961 | Everett | 181/257 |

*Primary Examiner*—L. T. Hix

*Assistant Examiner*—Benjamin R. Fuller

*Attorney, Agent, or Firm*—Andrus, Sceales, Starke & Sawall

[57] ABSTRACT

A vent silencer including an outer housing having an inlet and an outlet, and a divider plate is disposed within the housing and divides the housing into an upstream inlet chamber and a downstream chamber. Located within the inlet chamber and communicating with the inlet is a primary diffuser, while a series of parallel perforated tubes are located within the downstream chamber and a sound absorbing material is packed around the tubes. The upstream ends of the tubes are closed and project beyond the plate into the inlet chamber. The sound energy is attenuated in passing from the primary diffuser into the inlet chamber and further attenuation is achieved as the sound energy passes through the perforations into the projecting ends of the tubes.

6 Claims, 3 Drawing Figures

Fig. 1
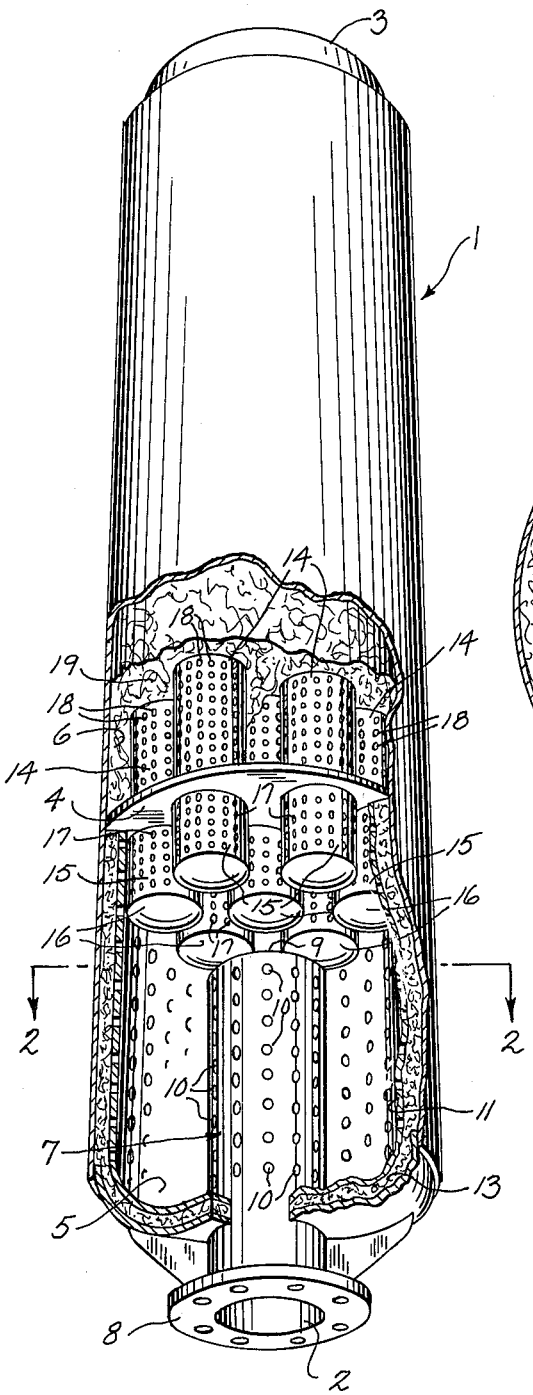
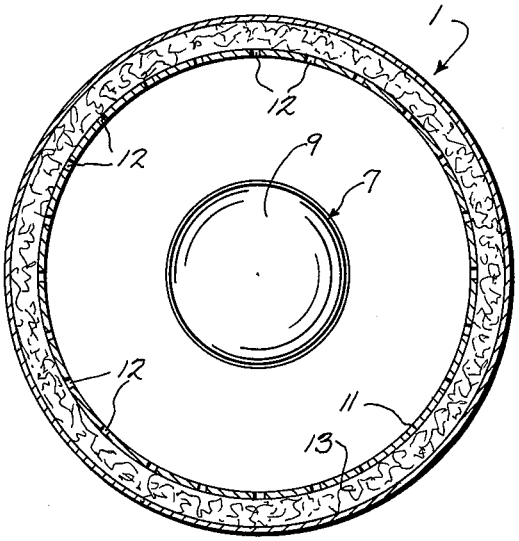
Fig. 2
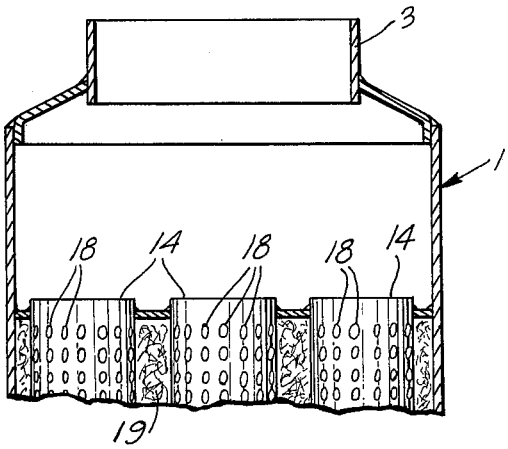
Fig. 3

VENT SILENCER

BACKGROUND OF THE INVENTION

Vent silencers are used to silence high velocity air or gas flowing to and from the atmosphere, while also finding use in reducing discharge noises on air cylinders, vent lines, air motors, and the like.

One common form of vent silencer is the splitter type in which a perforated, rounded-nose bullet or splitter is mounted within the silencer housing and contains sound absorbing material. Sound energy passes through the holes or perforations and is absorbed in the material within the splitter.

A second common type of vent silencer is a tube-type in which a series of parallel perforated tubes are mounted within the housing and a sound absorbing material is packed around the tubes. The tube-type silencer acts to enhance the effectiveness of the sound absorbing material by providing an increased ratio of perimeter to flow passage cross sectional area. However, the tube-type of vent silencer has certain disadvantages. As the upstream ends of the tubes are normally open, high frequency sound energy can be beamed directly through the tubes. As a further consideration, erosion of the acoustic pack material surrounding the tubes can result due to direct impingement of the kinetic energy from the diffuser jets on the pack material. This problem has been particularly evident in vent silencer designs in which the primary diffuser extended radially or laterally with respect to the housing.

In an attempt to minimize this problem, radial diffusers in the past, have been constructed so that the portion of the diffuser facing the tube bundle has no holes or perforations.

The use of radial diffusers in a tube-type silencer has also generated aerodynamic noise due to the jets from the diffuser impinging upon the central plate which supports the upstream ends of the tubes. This aerodynamic noise was enhanced in prior designs by edge tone noise from the tubes themselves.

SUMMARY OF THE INVENTION

The invention is directed to an improved vent silencer to be used in attenuating sound energy. In accordance with the invention, the silencer includes an outer housing having an inlet connected to the vent and an outlet. Located between the inlet and outlet is a central plate or baffle which defines an upstream inlet chamber and a downstream chamber.

A primary diffuser is disposed within the upstream inlet chamber and communicates with the inlet. The inner or downstream end of the diffuser is closed and the peripheral surface of the diffuser is provided with a plurality of holes or perforations which communicate with the inlet chamber.

Mounted in the downstream chamber is a series of generally parallel, perforated tubes, and a sound absorbing material is packed around the tubes. The upstream ends of the tubes are closed and project beyond the baffle plate into the inlet chamber. The downstream ends of the tubes are open and communicate with the outlet of the housing.

In operation, the sound energy being emitted from the vent enters the inlet and is attenuated as it passes through the holes in the primary diffuser into the inlet chamber. Further attenuation is achieved as the sound energy passes through the holes in the projecting ends of the tubes into the tube interiors, and additional attenuation is achieved by sound energy being absorbed in the acoustic pack material which surrounds the perforated tubes.

The vent silencer of the invention achieves a high degree of sound attenuation and in normal installations a 20 to 60 decibel attenuation can be achieved with an input in the range of 120 to 170 decibels.

By capping the upstream ends of the perforated tubes, a reverse flow diffusion is achieved as the sound energy passes from the inlet chamber through the holes into the interior of the tubes. The reverse flow diffusion provides increased attenuation by increasing the acoustic resistance.

The capped ends of the tubes also prevent the direct beaming of high frequency sound waves through the tubes, thereby resulting in greater attenuation of the high frequency waves.

The capped or closed tube ends prevent direct impingement of the jet kinetic energy on the acoustic pack material, thereby minimizing erosion of the pack material. Furthermore, since the ends of the tubes are capped the diffuser jets will not impinge directly on any open tube ends, thereby reducing aerodynamic noise over prior designs of tube-type silencers.

By adjusting the length of the projecting ends of the tubes, the pressure drop into the tubes can be adjusted.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the vent silencer of the invention with parts broken away; and FIG. 2 is a section taken along line 2—2 of FIG. 1.

FIG. 3 is a fragmentary longitudinal section of the upper end portion of the vent silencer.

DESCRIPTION OF THE PREFERRED EMBODIMENT

FIG. 1 illustrates a vent silencer of the invention which includes a generally cylindrical housing 1, having an inlet 2 at one end and an outlet 3 at the opposite end. A plate-like baffle or divider 4 is secured across the interior of the housing 1 and divides the housing to an upstream inlet chamber 5 and a downstream chamber 6.

Secured within the inlet 2 is a generally cylindrical diffuser 7, and the outer end of the diffuser is provided with a flange 8 for connection to a vent. The inner end 9 of the diffuser is closed, and the peripheral surface of the diffuser is formed with a plurality of radial holes 10 or perforations which provide communication between the interior of the diffuser 7 and the inlet chamber 5.

Spaced inwardly from the housing 1 is a metal liner 11 having a series of holes 12 and a sound absorbing material 13, such as fiber glass, is located within the space between the liner 11 and the outer housing 1.

A plurality of generally parallel perforated tubes 14 are located within the chamber 6 and the upstream end portions 15 of the tubes project beyond the plate 4 and are provided with closed ends 16. Holes or perforations 17 are formed in the projecting end portions 15 of tubes 14, while holes 18 are provided in the portions of the tubes located within the chamber 6. A mass of sound absorbing material 19, such as fiber glass, is located around the tubes in the chamber 6.

In operation, the sound energy from the vent enters the inlet 2 and is attenuated as it is discharged radially through the holes 10 in the diffuser 7 into chamber 5. A portion of the sound energy is absorbed in the acoustic pack material 13 which surrounds the inlet chamber 5.

The sound energy then passes radially through the holes 17 into the projecting end portions 15 of the tubes 14 and a second degree of sound attenuation is achieved by this reverse diffusion. Further attenuation is obtained by virtue of the sound energy being absorbed in the acoustic pack material 19 which surrounds the perforated tubes 14.

The projecting portions 15 of the tubes 14, which are closed at their upstream ends, provide a reverse diffusion, resulting in a high degree of attenuation of the sound energy by increasing the acoustic resistance.

The closed ends 16 of the tubes also prevent the direct beaming of sound energy, particularly high frequency waves, directly through the tubes, and also serve to reduce erosion of the acoustic pack material 19 by preventing direct impingement of the diffuser jet on the material.

Since the ends of the projecting portions 15 of the tubes 14 are capped with closed ends 16, the diffuser jets will not impinge directly on any open tube ends, thus reducing the generation of aerodynamic noises over prior designs.

Various modes of carrying out the invention are contemplated as being within the scope of the following claims particularly pointing out and distinctly claiming the subject matter which is regarded as the invention.

We claim:

1. An acoustical silencer, comprising a housing having an inlet to be connected to a device emitting sound energy and having an outlet, divider means dividing said housing into an upstream chamber communicating with said inlet and a downstream chamber communicating with said outlet, a diffuser disposed within the upstream chamber and connected to said inlet and having at least one aperture therein providing communication between the interior of the diffuser and the inlet chamber, a tube disposed within the downstream chamber with the upstream end portion of the tube projecting beyond said divider means into said upstream chamber and the upstream end of the tube being closed, first port means disposed in the projecting end portion of the tube and providing communication between the upstream chamber and the interior of the tube, a sound absorbing material disposed within the downstream chamber in the space surrounding said tube, and second port means disposed in the portion of the tube located within said downstream chamber and providing communication between the interior of the tube and said space.

2. The silencer of claim 1, wherein said inlet and outlet are disposed in axial alignment and said diffuser extends axially of the housing, the downstream end of the diffuser being closed and said apertures extending radially of said diffuser.

3. The silencer of claim 1, and including a liner located within the inlet chamber and spaced inwardly of said housing said liner having a plurality of holes, and a sound absorbing material disposed within the space between the liner and the housing.

4. The silencer of claim 1, wherein said first and second port means each comprises a plurality of holes extending around the periphery of the tube.

5. A vent silencer, comprising a housing having an inlet and an outlet, a plate disposed transversely of the housing and dividing the housing into an upstream inlet chamber and a downstream chamber, a diffuser disposed within the inlet chamber and connected to said inlet, the downstream end of said diffuser being closed and said diffuser being formed with a plurality of apertures providing communication between the interior of the diffuser and the inlet chamber, a plurality of tubes mounted on said plate, the upstream end portions of the tubes projecting into said inlet chamber and the upstream ends of the tubes being closed, the downstream ends of the tubes being open and communicating with said outlet, the projecting end portion of each tube having a plurality of radially extending openings providing communication between the inlet chamber and the interior of the respective tube, and the portion of each tube located downstream of said plate in said downstream chamber having a plurality of second openings, and a mass of sound absorbing material disposed in said downstream chamber and surrounding said tubes.

6. The silencer of claim 5, wherein the tubes are spaced apart and said sound absorbing material is located within the space between the tubes.

* * * * *